US005854583A

United States Patent [19]

Falchetti

[11] Patent Number: 5,854,583

[45] Date of Patent: Dec. 29, 1998

[54] AUTOMOTIVE-TYPE FUSE FOR LARGE CURRENTS

[75] Inventor: Antonio Falchetti, Codogno, Italy

[73] Assignee: Meccanotecnica Codognese S.p.A., Italy

[21] Appl. No.: 777,594

[22] Filed: Dec. 31, 1996

[51] Int. Cl.[6] ..... H01H 85/02; H01H 85/143; H01H 85/15

[52] U.S. Cl. ..... 337/290; 337/159; 337/180; 337/181

[58] Field of Search ..... 337/290, 186, 337/187, 201, 206, 295, 241, 265; 361/104, 807, 809; 439/621, 622, 775, 884, 890, 883, 893, 2, 399, 430, 449, 474, 869, 870, 871, 872, 873, 874, 875, 876, 877

[56] References Cited

U.S. PATENT DOCUMENTS

| | | | |
|---|---|---|---|
| 1,874,949 | 8/1932 | Fogal | 337/246 |
| 4,837,546 | 6/1989 | Bernstein | 337/272 |
| 5,113,169 | 5/1992 | Ruehl et al. | 337/265 |
| 5,229,739 | 7/1993 | Oh et al. | 337/290 |
| 5,293,147 | 3/1994 | Oh et al. | 337/227 |
| 5,590,026 | 12/1996 | Warren et al. | 361/704 |

*Primary Examiner*—Lynn D. Feild
*Assistant Examiner*—Anatoly Vortman
*Attorney, Agent, or Firm*—Burns, Doane, Swecker & Mathis, L.L.P.

[57] ABSTRACT

Automotive-type fuse for large currents, in which a generally rectangular metal strip of tin-plated zinc, with a central portion shaped to form a conductor of smaller conducting cross section, is provided, at each of its opposite ends, with a circular hole for the screw of an electrical terminal clamp, this hole being surrounded by an annular insert caulked into the strip, made of metal, such as copper with tellurium or with beryllium, with a modulus of elasticity and yield-point stress higher than that of zinc, to ensure the stability of the screw clamp, even under vibration, with a clamping pressure greater than the yield-point stress of zinc, by means of the elastic reaction exerted by the ring. The central portion of the strip, having the function of a fusible element, is advantageously housed in an opaque plastic containment housing provided with two juxtaposed windows, on opposite sides of the fusible element, so that the condition of the fuse can be checked visually, the windows being closed by transparent plastic shields.

5 Claims, 1 Drawing Sheet

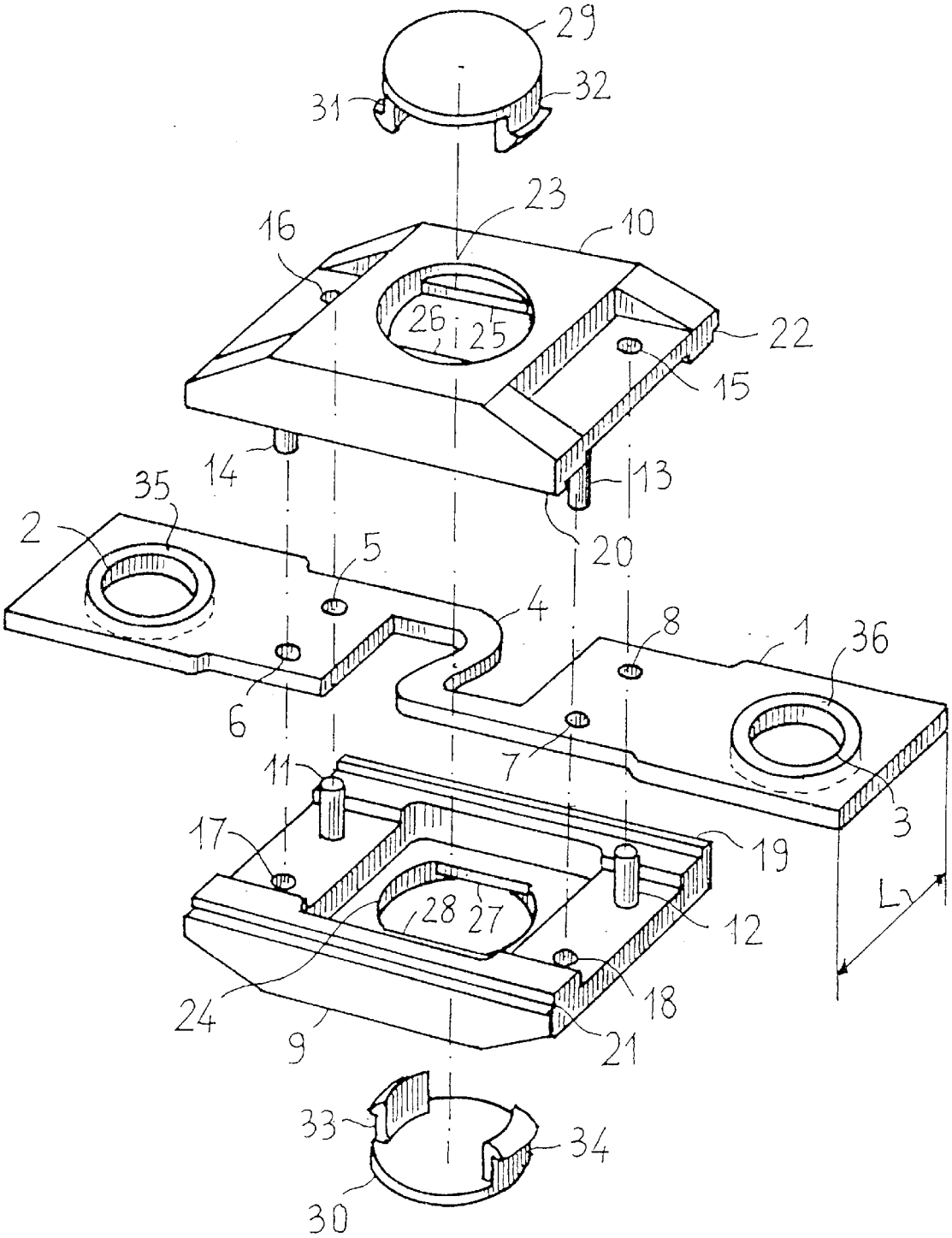
29
31
32
23
16
10
26
25
22
15
14
13
35
2
5
20
4
8
1
36
6
7
11
3
17
19
28
27
12
L
24
18
9
21
33
34
30

AUTOMOTIVE-TYPE FUSE FOR LARGE CURRENTS

BACKGROUND OF THE INVENTION

The present invention relates to an automotive-type fuse for large currents.

For power applications on vehicles, there have recently been introduced into the market fuses consisting of a metal strip of copper, zinc or alloys of these, generally being elongate with a narrow intermediate section shaped into an S by way of an element of locally increased resistance, with pierced ends connected by means of screw clamps to an electric line which it is wished to protect.

When a current of predetermined strength is passed through it, the section of locally increased resistance heats up until it melts and so breaks the electrical continuity.

Among the various materials used, zinc is preferable because of its low melting point (419.5° C.) and its thermal conductivity (95 cal/hour.m.°C.), both of which are lower than for copper, and give a faster response for the protective device, with localized heating at a temperature and heat well below that of a copper fuse of equal power.

In spite of these advantages, zinc has, from a mechanical point of view, the serious drawback of high plasticity, above that of copper, and in conditions of much lower stresses than are necessary for plastic deformation of copper, especially if work-hardened or alloyed with hardeners such as beryllium or tellurium.

Its modulus of elasticity is also lower than that of copper.

Therefore, when the ends of the fuse are clamped in the screw clamps, they deform plastically and are unable to exert sufficient elastic reaction to prevent, by friction, the unscrewing and slackening of the clamps, resulting in bad electrical contacts and dangerous overheating.

SUMMARY OF THE INVENTION

The present invention solves these limitations and provides a fuse in zinc (or other suitable metal/alloy having a low melting point and relatively high plasticity), with fixing terminals for clamping in screw clamps, which terminals possess sufficient mechanical strength and are capable of exerting sufficient elastic reaction to give the clamps stable clamping and prevent them from unscrewing and slackening even under vibration.

These results are achieved by providing each of the pierced ends of the zinc strip, which forms the fuse, with an annular insert that surrounds the through hole of the screw of the clamp, its thickness being approximately equal to that of the strip, and being made of a material having a modulus of elasticity and yield-point stress higher than those of zinc and, at the same time, good electrical conductivity.

Examples of preferred materials are copper with tellurium and copper-plated and tin-plated steel.

The annular insert, in the form of a cylindrical bush is caulked into the hole to ensure a stable and inseparable mechanical and electrical connection with the end of the zinc strip.

This feature is advantageously combined with other characteristics which make the fuse highly efficient.

The use of zinc rather than copper to make the fuse makes the latter very fast-acting in its protective function.

Obviously, however, even though the melting point of zinc is much lower than that of copper, the response of the fuse will be made more immediate if heat loss is kept down.

Therefore, in order to enable the protective device to respond more efficiently, the area of smaller conducting cross section and increased resistance must be protected by an insulating housing.

This housing has many functions: it must provide suitable thermal insulation, enabling the material to reach its melting point even if the resistance of the fusible element is low.

It must provide mutual mechanical support and anchorage for the ends of the fusible strip even when the fusible element is broken.

It must prevent the molten metallic material from escaping from the housing.

To these functional characteristics there must also be added high resistance to the elevated temperatures that build up in the event of current overload and activation of the protective function, non deformability and great mechanical strength.

To satisfy these requirements it is necessary to use insulating plastic materials suitably filled with reinforcing material such as glass fibres or the like.

Fillers make the plastic material completely opaque and will not allow visual checking of the condition of the fuse, unlike fuses of lower capacity, such as so-called metal strip fuses, in which the fuse is housed in a transparent plastic housing.

The possibility of a visual check of the condition of the fuse, without the need for electrical measuring instruments, is however extremely useful, if not mandatory, and must permit visual checking even under uncertain lighting conditions.

This result is achieved according to the present invention by a fuse housed in a plastic housing having two windows on opposite sides of the fusible element, the windows being closed by two shields of transparent plastic material.

The two windows allow a visual check to be made of the condition of the fuse either by reflection of image and light through either window or by observation of the fusible element through the transparency of both windows, so that checking it is easy under the most varied lighting conditions.

The performance of the device is not compromised by the two windows because the necessary mechanical strength and non deformability is ensured by the plastic housing, and the thermal insulation and complete closure of the housing are ensured jointly by the housing and by the shields that close the windows.

In accordance with another feature of the invention, the shields that close the windows are shaped in such a way that they can be snap-fitted onto the housing, in the final stage of the manufacturing process, so that after the fuse has been assembled, and before the shields are fitted, the fuse can be checked, through the open windows, by inputting currents of predetermined values and taking direct measurements of its thermal characteristics by means of thermal sensors applied to the heat-fusible zone through the windows.

This replaces testing systems based on measurements of resistance, which are therefore indirect and influenced by a multiplicity of factors.

BRIEF DESCRIPTION OF THE DRAWINGS

The characteristics and advantages of the invention will be made clearer by the following description of a preferred embodiment, given by way of non-restrictive example, with reference to the accompanying FIGURE.

The figure is an exploded perspective view of a preferred embodiment of the fuse according to the invention.

DESCRIPTION OF A PREFERRED EMBODIMENT

The fuse consists of a metal strip 1 of basically elongate rectangular shape, provided at each end with two circular through holes 2, 3 for two clamping screws joining it to corresponding electrical terminals.

The strip 1 is punched from a strip of zinc, preferably tin-plated after the punching operation. The punch also forms, at the ends of the strip, two circular holes that are rather wider in diameter than the holes 2, 3 for housing two bushes of non-zinc material.

By way of indication, the strip may have a thickness of 1.8 mm and a width L, at its ends, of 16 mm.

The circular holes 2, 3 have, by way of indication, a diameter of about 8.6 mm to allow easy insertion of bolts or screws with a nominal diameter of 8 mm.

These holes are each formed inside a bush 35, 36, respectively, made of copper with tellurium, copper with beryllium or other equivalent material (in this case even steel) having a high modulus of elasticity, advantageously more than 10,000 kg/mm$^2$, and a high yield-point stress, advantageously more than 20 kg/mm$^2$, i.e. at least twice that of the zinc.

The external diameter of the bushes is advantageously about 11–11.6 mm, with a thickness approximately equal to (or slightly less than) that of the zinc strip (1.8 mm).

The bushes 35, 36 are inserted into the corresponding holes formed in the strip 1 and fixed in this by caulking, that is, by applying pressure with a suitable punch or roller on the opposite plane sides of the bushes, around the circumference that is coaxial with the holes 2, 3 and has a diameter intermediate between the internal and external diameters of the bushes.

The application of pressure causes the bushes to expand and lock themselves firmly to the strip 1, taking up any dimensional tolerances and the play between the external diameter of the bushes and the diameter of the holes of the strip (this play being necessary for easy insertion).

In the central zone of the strip 1 there is formed, preferably by cutting or punching, a conducting element 4 of reduced cross section performing specifically the role of fusible element.

In order to provide a convenient length of the fusible element in a small space, the element is S-shaped.

On the strip 1 there are formed, between the fusible element 4 and the holes for fixing the fuse to electrical terminals, two pairs of holes 5, 6 and 7, 8 respectively at the opposite ends of the heat-fusible element.

Two plates 9, 10 moulded in reinforced plastic material and roughly rectangular in shape are connected together, with the central portion of the strip 1 between them, by means of a pair of pins 11, 12 and 13, 14 with which each plate is provided.

The pins of each plate pass into a pair of holes such as 5, 8 and 6, 7 in the strip 1 and into corresponding holes such as 15, 16 and 17, 18 in the opposite plate, in which they are fixed by thermoplastic compressive welding.

Advantageously, two opposite parallel edges on both plates are provided, respectively, with a rib in relief 19, 20 and with a rebate 21, 22, these fitting together to ensure precise positioning of the two plates with respect to each other.

The ribs 19, 20 may also undergo thermoplastic compressive welding to corresponding rebates in the opposite plate.

The two plates, each provided with a recess in the surface facing the heat-fusible element 4, form a rigid insulating containment housing set back from the fusible element. The housing keeps the fuse together even if the fusible element melts and breaks.

The housing also provides suitable thermal insulation for the fusible element and prevents molten conducting material from escaping if the protective device is triggered.

The two plates 9, 10 are provided on their two sides nearest the thermofusible element 4 with two generally cylindrical windows or holes 23, 24, inside which there are two diametrically opposite supporting shoulders 25, 26 and 27, 28 in the shape of cylindrical segments.

The two windows 23, 24 are closed by two discoidal shields 29, 30, respectively, made of transparent plastic material such as polystyrene, polyester or methacrylate, each having two diametrically opposite spring lugs 31, 32 and 33, 34 ending in a locking tooth.

The spring lugs 31, 32 and 33, 34 snap home by elastic deformation into the windows 23, 24 respectively with an irreversible snap-fitting action of the locking teeth into the walls of the windows.

When fastened, the shields 29, 30 are housed inside the windows and rest on the shoulders 25, 26 and 27, 28, irreversibly closing the windows but allowing visibility from the outside of the thermofusible element housed inside the housing.

Because the two windows are positioned on opposite sides of the thermofusible element, visibility of the thermofusible element is ensured either by reflection of light through either window or by examining its profile through the pair of transparent windows.

Furthermore, as already stated, the fitting of the transparent window shields after the housing has been assembled means that direct thermal checking of the fusible element is possible, with the housing being completed afterwards.

It also offers the advantage that the two plates can be heat welded without the risk of damaging or opacifying the plastic material of the shields, which are applied only afterwards.

Clearly, the above description relates only to one preferred embodiment of the invention, and many variants may be made.

For example, the windows 23, 24 need not be generally cylindrical but may instead be ovoid, quadrangular or rectangular in section.

Furthermore, the bushes 35, 36 need not have a cylindrical external peripheral wall but may have a toothed or polygonal external peripheral wall and be housed in the strip in holes of corresponding shape so that their caulking together has greater resistance to possible torque resulting, by friction, from direct contact with a nut or the head of a screw of the clamp. This condition may result from improper clamping, it being obvious that, generally speaking, a metal bush is interposed between the nut or head of a clamping screw, to avoid the moveable clamping element sliding directly against a stationary part.

I claim:

1. A fuse for large currents, comprising a conducting metal strip with a central portion shaped to form a conductor of smaller conducting cross section, having the function of a usable element, with two end portions each having a through hole for a screw clamping member, and a housing that contains said fusible element, is integral with said metal strip and is made up of a pair of juxtaposed plates with said central portion of the strip interposed between them, characterized in that each of said holes houses a bush made of copper with tellurium, tin-plated steel or other conducting material with a yield-point stress and modulus of elasticity greater than that of zinc, so that even when said clamping member exerts clamping pressures greater than the compressive yield stress of the zinc, there is no plastic deformation of the strip and relaxation of the clamping pressure.

2. Fuse according to claim 1, in which said housing is made of an opaque plastic material and is provided with a pair of windows each formed in one of said plates, on opposite sides of said interposed fusible element, said windows being closed by shields of transparent plastic material.

3. Fuse according to claim 2, in which said shields are provided with toothed lugs for snap fastening in said windows, into which they are fitted from the outside of said housing.

4. Fuse according to claim 2, in which said shields and said windows are of discoidal and cylindrical shape, respectively, to house said shields within said windows, said windows being provided internally with shoulders to support said shields.

5. Fuse according to claim 3, in which said shields and said windows are of discoidal and cylindrical shape, respectively, to house said shields within said windows, said windows being provided internally with shoulders to support said shields.

* * * * *

UNITED STATES PATENT AND TRADEMARK OFFICE

CERTIFICATE OF CORRECTION

PATENT NO. : 5,854,583

DATED : December 29, 1998

INVENTOR(S) : Antonio Falchetti

It is certified that error appears in the above-indentified patent and that said Letters Patent is hereby corrected as shown below:

Cover page, Column 1, insert the following:

Item [30] --Foreign Application Priority Data

April 24, 1996 Italy.....MI96 A 000820--

Signed and Sealed this

Eighth Day of June, 1999

*Attest:*

Q. TODD DICKINSON

*Attesting Officer*

*Acting Commissioner of Patents and Trademarks*